US010980394B2

(12) United States Patent
Woo et al.

(10) Patent No.: US 10,980,394 B2
(45) Date of Patent: Apr. 20, 2021

(54) DISHWASHER

(71) Applicant: LG Electronics Inc., Seoul (KR)

(72) Inventors: Sangwoo Woo, Seoul (KR); Minseong Kim, Seoul (KR); Hyungman Park, Seoul (KR)

(73) Assignee: LG Electronics Inc., Seoul (KR)

( * ) Notice: Subject to any disclaimer, the term of this patent is extended or adjusted under 35 U.S.C. 154(b) by 88 days.

(21) Appl. No.: 16/523,287

(22) Filed: Jul. 26, 2019

(65) Prior Publication Data

US 2020/0029780 A1 Jan. 30, 2020

(30) Foreign Application Priority Data

Jul. 26, 2018 (KR) ..... 10-2018-0087038
Apr. 23, 2019 (KR) ..... 10-2019-0047376

(51) Int. Cl.
*A47L 15/00* (2006.01)
*A47L 15/42* (2006.01)

(52) U.S. Cl.
CPC ..... *A47L 15/4234* (2013.01); *A47L 15/0015* (2013.01); *A47L 15/4225* (2013.01); *A47L 15/4278* (2013.01); *A47L 15/4285* (2013.01)

(58) Field of Classification Search
CPC ..... A47L 15/4234; A47L 15/0015; A47L 15/4225; A47L 15/4278; A47L 15/4285
See application file for complete search history.

(56) References Cited

U.S. PATENT DOCUMENTS

2017/0188777 A1 7/2017 Kim et al.
2017/0188781 A1 7/2017 Lee et al.

FOREIGN PATENT DOCUMENTS

| | | | | |
|---|---|---|---|---|
| JP | 2008229309 | | 10/2008 | |
| KR | 1020070099358 | | 10/2007 | |
| KR | 1020080006409 | | 1/2008 | |
| KR | 101678442 | B1 * | 12/2016 | ..... A47L 15/4278 |
| KR | 101877387 | | 7/2018 | |
| WO | WO2016028049 | | 2/2016 | |
| WO | WO2017022974 | | 2/2017 | |

OTHER PUBLICATIONS

Australian Office Action in Australian Application No. 2019208248, dated Apr. 9, 2020, 2 pages.
PCT International Search Report in International Application No. PCT/KR2019/009358, dated Nov. 18, 2019, 4 pages.

* cited by examiner

*Primary Examiner* — Michael E Barr
*Assistant Examiner* — Pallavi Chitta
(74) *Attorney, Agent, or Firm* — Fish & Richardson P.C.

(57) ABSTRACT

A dishwasher includes: a tub that defines an washing chamber; spray nozzles configured to spray washing water into the washing chamber; a sump configured to store washing water; a steam nozzle configured to supply steam to the washing chamber; a washing pump housing coupled to the sump and connected to the spray nozzles or the steam nozzle; a heater configured to heat washing water in the washing pump housing; a washing motor configured to rotate an impeller; a washing water outflow pipe defining an outflow path protruding outward from one side of the washing pump housing; a steam discharge pipe that extends from a discharge port defined at a circumferential surface of the washing water outflow pipe; and a first protrusion disposed in an upper portion of the outflow path and disposed downstream of the discharge port in a flow direction of the washing water.

20 Claims, 12 Drawing Sheets

DISHWASHER

CROSS-REFERENCE TO RELATED APPLICATIONS

This application claims priority to Korean Application No. 10-2019-0047376, filed on Apr. 23, 2019, and Korean Application No. 10-2018-0087038, filed on Jul. 26, 2018. The disclosures of the prior applications are incorporated by reference in their entirety.

FIELD

The present invention relates to a dishwasher, and more particularly, to a dishwasher which smoothly supplies steam to a steam nozzle.

BACKGROUND

A dishwasher is a household appliance for washing dirt such as food wastes on dishes or cooking utensils (hereinafter, referred to as 'washing target') by high-pressure washing water sprayed from a spray arm.

The dishwasher generally includes a tub forming a washing chamber and a sump mounted in the bottom of the tub to store the washing water. The washing water is moved to the spray arm by the pumping action of a washing pump mounted inside the sump, and the washing water moved to the spray arm is sprayed at a high pressure through a spray hole formed in the spray arm. Then, the washing water sprayed at a high pressure impinges against the surface of the washing target, so that the dirt on the washing target drops to the bottom of the tub.

Meanwhile, the dishwasher may perform cleaning or sterilization by using the heated washing water to wash the washing target or to supply steam to the washing target.

U.S. Pat. No. 9,211,049B2 discloses that washing water is heated to supply steam to the inside of a washing pump, or the washing water is supplied to the inside of the washing pump through an impeller through a spray nozzle. In the above-mentioned document, in the housing in which the heater is disposed, a partition is provided in an upper side to form a space through which the washing water or the steam is discharged to a first section or a second section. Such a structure requires a separate flow-forming structure of washing water to form the flow of washing water or steam.

In addition, in the above structure, when the impeller for the flow of washing water is disposed inside the housing in which the heater is disposed, the washing water flows into a space where the steam flows due to the pressure formed inside the housing. Thus, there is a problem that the discharge of steam or the discharge of washing water cannot be smoothly performed.

SUMMARY

The present invention has been made in view of the above problems, and provides a dishwasher that smoothly supplies washing water and steam discharged from a washing pump, in which a flow of washing water is formed by an impeller and washing water is heated by a heater, into a tub through each nozzle. In particular, it provides a dishwasher for smoothly supplying steam to a steam nozzle in consideration of characteristics of washing water and steam.

In order to separate the flow of the steam from a pipe through which the washing water is discharged, a pipe from which steam is discharged may be formed above the pipe through which the washing water is discharged, in consideration of the fact that the density of the steam is lower than that of the washing water. However, when the flow velocity of the washing water and the steam is equal to or higher than a certain level, it is difficult for the steam to flow through the pipe for discharging the steam. In order to solve such a problem, the present invention further provides a dishwasher in which the flow of steam is smoothly performed by the pipe through which steam is discharged by hindering the flow of steam around the pipe through steam is discharged.

The structure for suppressing the flow of steam around the pipe through which the steam is discharged may serve as a structure for suppressing the flow of the washing water. The present invention further provides a dishwasher in which the flow of washing water is not hindered due to the discharge structure of steam.

The present invention further provides a dishwasher having enhanced fastening force with a washing water supply pipe connecting the washing pump and the switching valve.

The dishwasher according to the present invention includes a washing pump for supplying washing water to the spray nozzle disposed in the tub or supplying steam to the steam nozzle. The washing pump according to the present invention can heat the washing water through the heater and form the flow of the washing water or the flow of the steam through the impeller. The washing pump discharges the washing water or steam to the washing water outflow pipe protruded to the circumferential surface of the washing pump housing. Further, in order to separate the flow of the steam in the washing water outflow pipe through which washing water and steam flow, a steam discharge pipe formed upward in the washing water outflow pipe is provided. The outflow pipe through which washing water or steam flows and the discharge port through which steam is discharged are formed in the washing water outflow pipe.

In the dishwasher of the present invention, the first protrusion for suppressing the flow of steam may be formed in the downstream of the washing water outflow pipe in which the steam discharging pipe is formed, so that the flow of steam to the steam nozzle can be ensured.

That is, a first protrusion disposed in the upper portion of the outflow path in downstream of the discharge port in the flow direction of the washing water flowing in the outflow path and for guiding the flowing steam to the discharge port is provided, so that the steam flowing in the washing water outflow pipe can flow to the steam discharge pipe. In this structure, an air trap which can be introduced into the discharge port can be formed in downstream of the discharge port, so that steam can be supplied to the steam nozzle. Since the steam has a lower density than the washing water, it can flow to the upper portion of the outflow path. The first protrusion has a semicircular shape convex upward from the upper portion of the outflow path, and suppresses the flow of steam at the downstream of the outflow, so that an air trap in which the steam stagnates at a distance adjacent the discharge port can be formed.

However, the structure of the first protrusion may hinder the flow of the washing water flowing through the washing water outflow pipe. Since the outflow path formed in the inside of the washing water outflow pipe extends downward as it progresses to downstream from the portion where the discharge port is formed. Thus, it has a structure where the cross section of the outflow path through which the washing water flows is not decreased, thereby not disturbing the flow of the washing water.

In addition, the structure, in which the outflow path formed in the washing water outflow pipe extends downward as it progresses to downstream from the portion where the discharge port is formed, guides the flow of the washing water having a high density downward, so that the washing water and steam can be separated well.

In addition, the first protrusion is disposed above the outflow path at a point where the downward extension of the outflow path is ended, so that the flow of steam flowing upward can be restricted.

A length, which is extended as it moves to downstream from the portion where the discharge port is formed, of a diameter of the outflow path formed in the inside of the washing water outflow pipe is equal to or larger than a height of the first protrusion protruded inward of the outflow path formed in the inside of the washing water outflow pipe, so that the first protrusion does not hinder the flow of the washing water.

The distance from the discharge port to the first protrusion is formed to be smaller than half a length of a cross-section of the outflow path formed in the inside of the washing water outflow pipe.

The dishwasher of the present invention further includes a switching valve which is disposed in an upper side of the washing water outflow pipe, and sends washing water discharged from the washing pump to at least one of the plurality of spray nozzles, and a washing water supply pipe which is provided with an inlet end and an outlet end that are vertically formed, and connects the washing water outflow pipe and the switching valve.

In addition, the first protrusion is formed in the inlet end of the washing water supply pipe connected to the washing water outflow pipe, so that the first protrusion may be disposed in the washing water supply pipe connected to the washing water outflow pipe.

The steam discharge pipe is formed in a direction inclined upward among a circumferential surface of the washing water outflow pipe at an upper portion of the washing water outflow pipe, so that the steam having a specific gravity smaller than that of washing water can flow easily.

The height of the first protrusion protruded downward from an upper end of the outflow path is longer than a length of a center of the discharge port spaced downward from an upper end of the outflow path, so that air trap can be formed around the discharge port.

The first protrusion includes a front surface that forms an inclination so as to face the washing water flowing in the outflow path formed in the washing water outflow pipe, and a rear surface that forms an inclination opposite to the front surface in downstream of the front surface, wherein an inclination angle of the front surface 108*a* with respect to a virtual horizontal line formed along an upper end of the washing water outflow pipe is formed gentler than an inclination angle formed with respect to the horizontal line by the rear surface, so that the first protrusion is formed so as not to hinder the flow of the washing water.

The outlet end of the washing water supply pipe connected to the switching valve is formed to be opened upward, the inlet end of the washing water supply pipe connected to the washing water outflow pipe is formed with an opening perpendicular to the outlet end, and the first protrusion is formed from the inlet end to a portion where the flow path is changed vertical.

The washing water supply pipe has an insertion groove, formed between an outer circumferential surface and the first protrusion, into which the washing water outflow pipe is inserted, so that the fastening structure of the washing water supply pipe and the washing water outflow pipe can be strengthened.

The second protrusion protruding inwardly of the outflow path is formed in the outflow path formed in the washing water outflow pipe so as to prevent the washing water flowing out from the washing pump housing from flowing into the discharge port, thereby restricting the flow of washing water to the steam discharge pipe.

The second protrusion is formed in the outflow path formed in the washing water outflow pipe in an upstream direction of the discharge port, thereby restricting the flow of washing water to the steam discharge pipe.

The discharge port formed in the washing water outflow pipe is disposed between the first protrusion and the second protrusion, so that air trap can be formed around the discharge port.

The washing water supply pipe includes: a horizontal pipe portion connected to the washing water outflow pipe; a vertical pipe portion connected to the switching valve, and formed perpendicular to the horizontal pipe; and a bending pipe portion connecting the horizontal pipe portion and the vertical pipe portion. Here, the first protrusion is formed in the horizontal pipe portion and the bending pipe portion, thereby suppressing the flow of steam at the end of the outflow path which flows horizontally.

BRIEF DESCRIPTION OF THE DRAWINGS

The above and other objects, features and advantages of the present invention will be more apparent from the following detailed description in conjunction with the accompanying drawings, in which.

DETAILED DESCRIPTION

Figure 1:
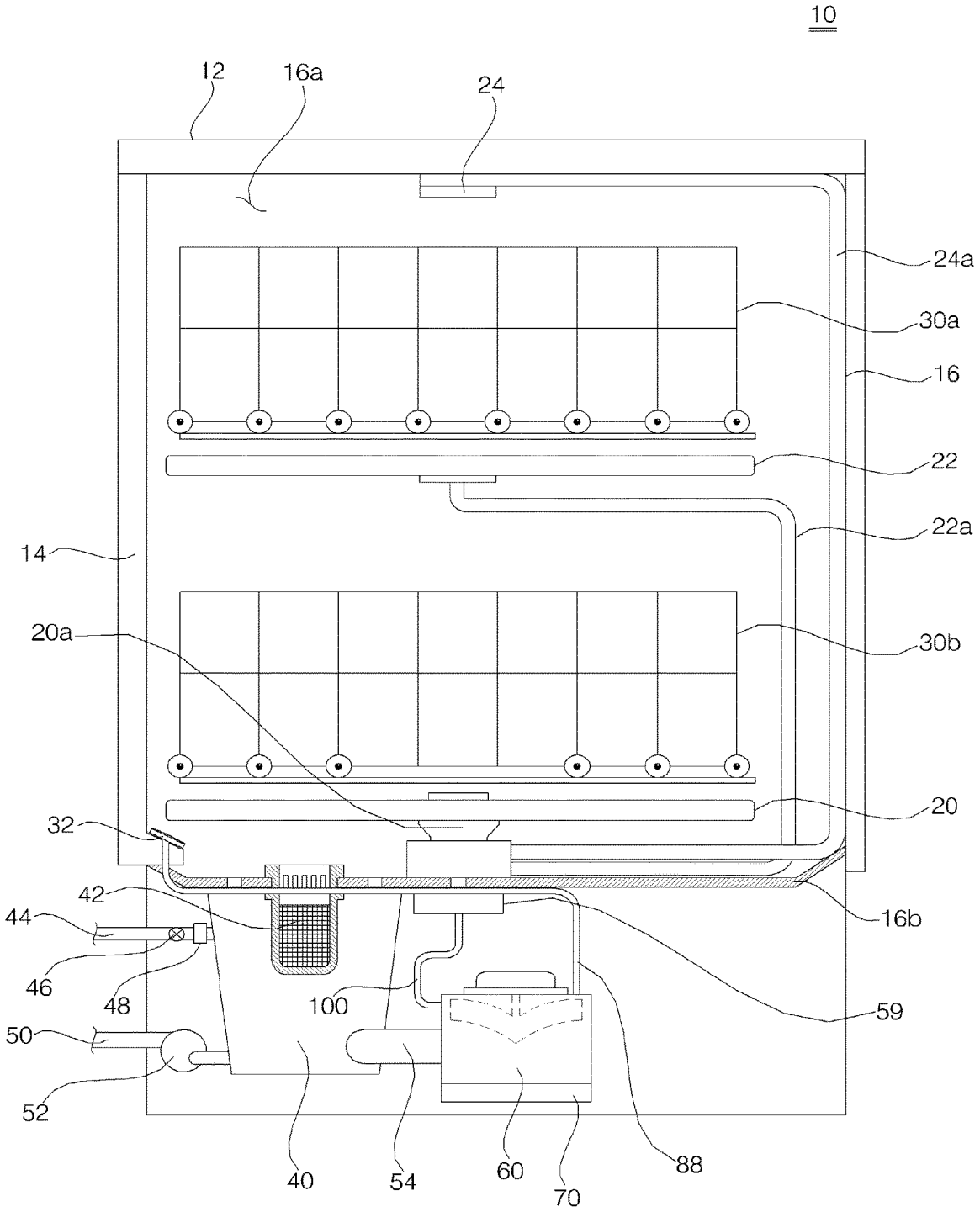
FIG. 1 is a schematic cross-sectional view for explaining the overall configuration of a dishwasher according to an embodiment of the present invention.
Figure 2:
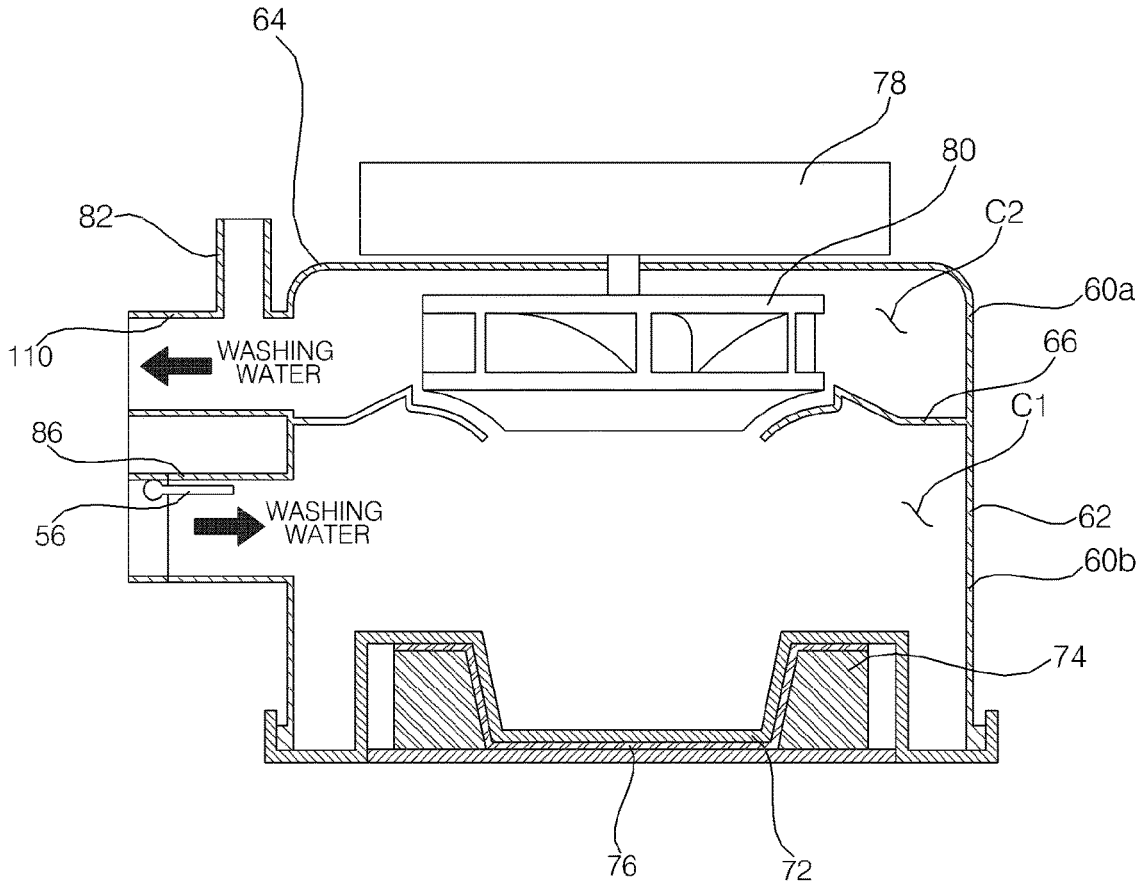
FIG. 2 is a schematic cross-sectional view for explaining a configuration of a washing pump of a dishwasher according to an embodiment of the present invention.
Figure 3:
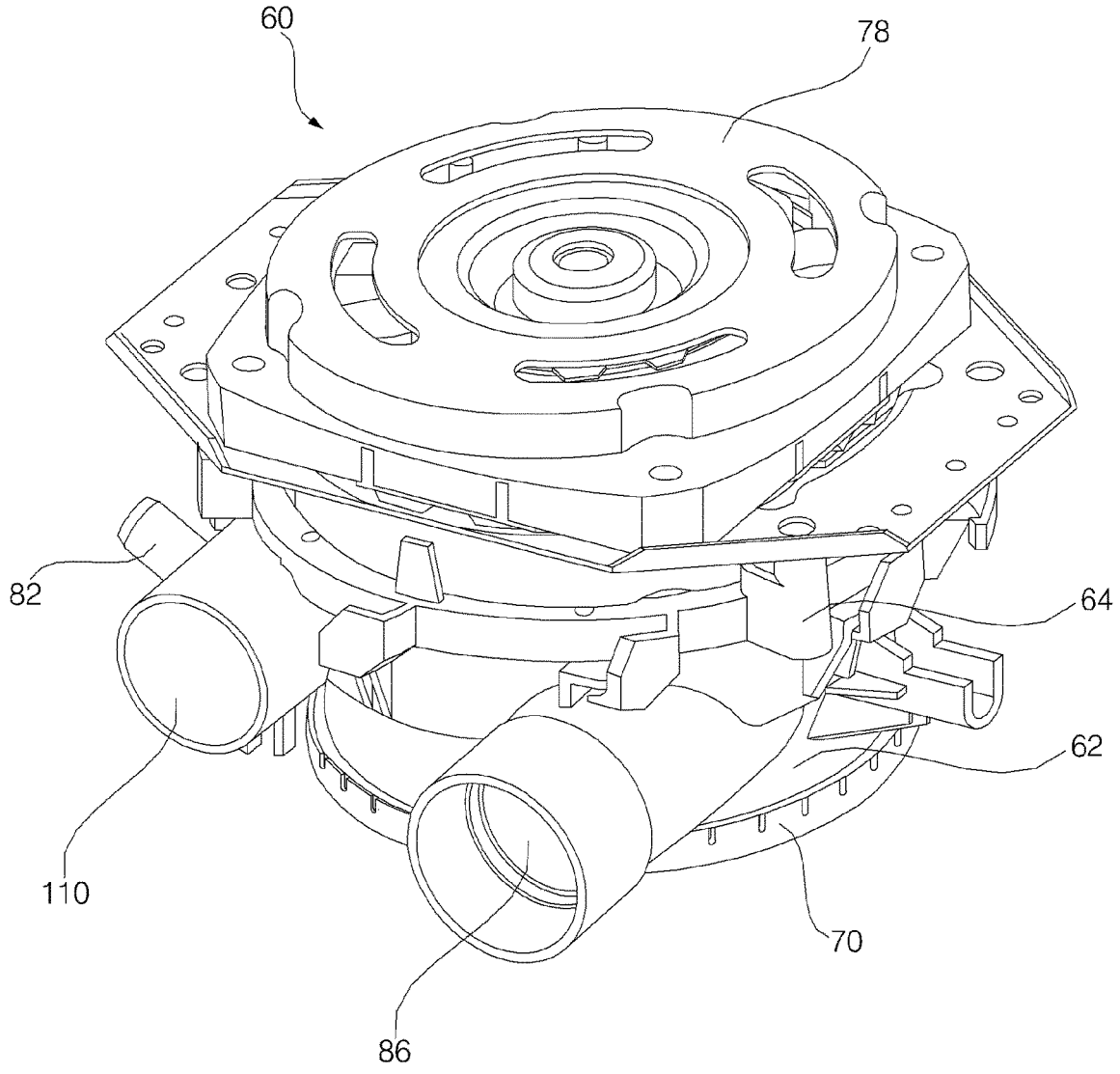
FIG. 3 is a perspective view of a washing pump according to an embodiment of the present invention.
Figure 4:
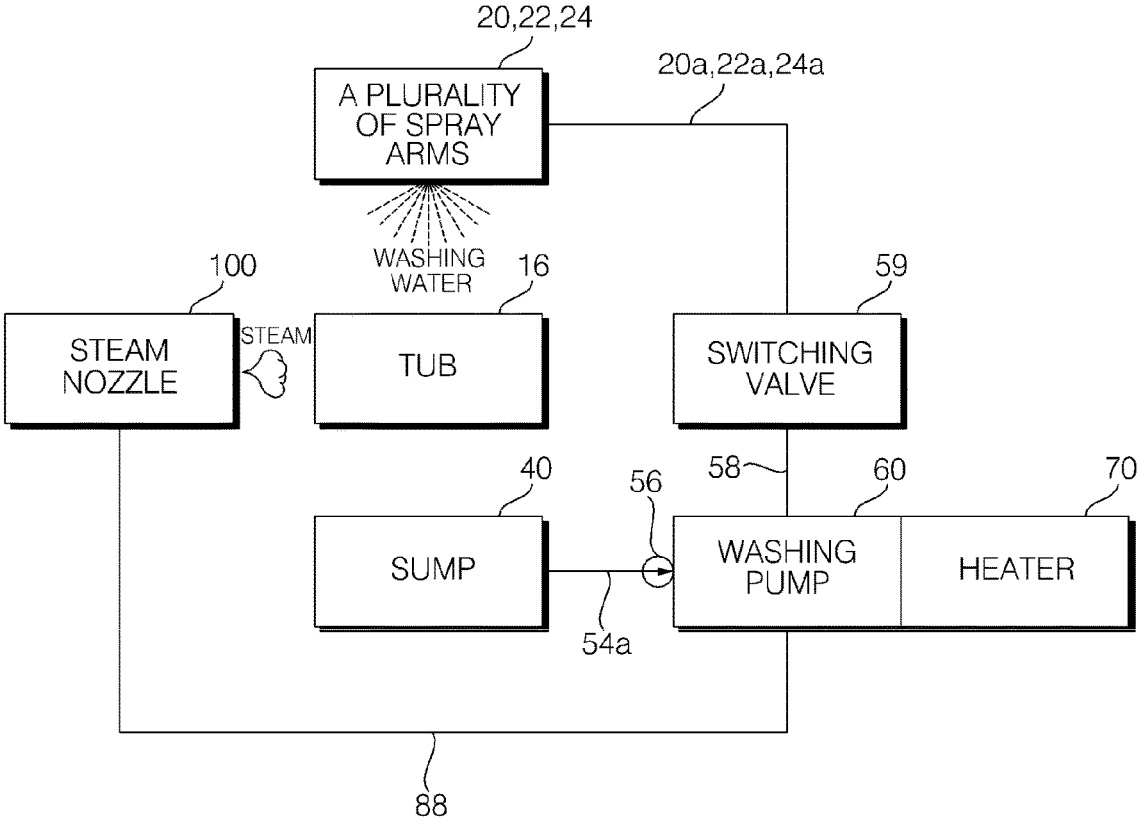
FIG. 4 is a block diagram illustrating the flow of washing water and steam flowing inside a dishwasher according to an embodiment of the present invention.
Figure 5:
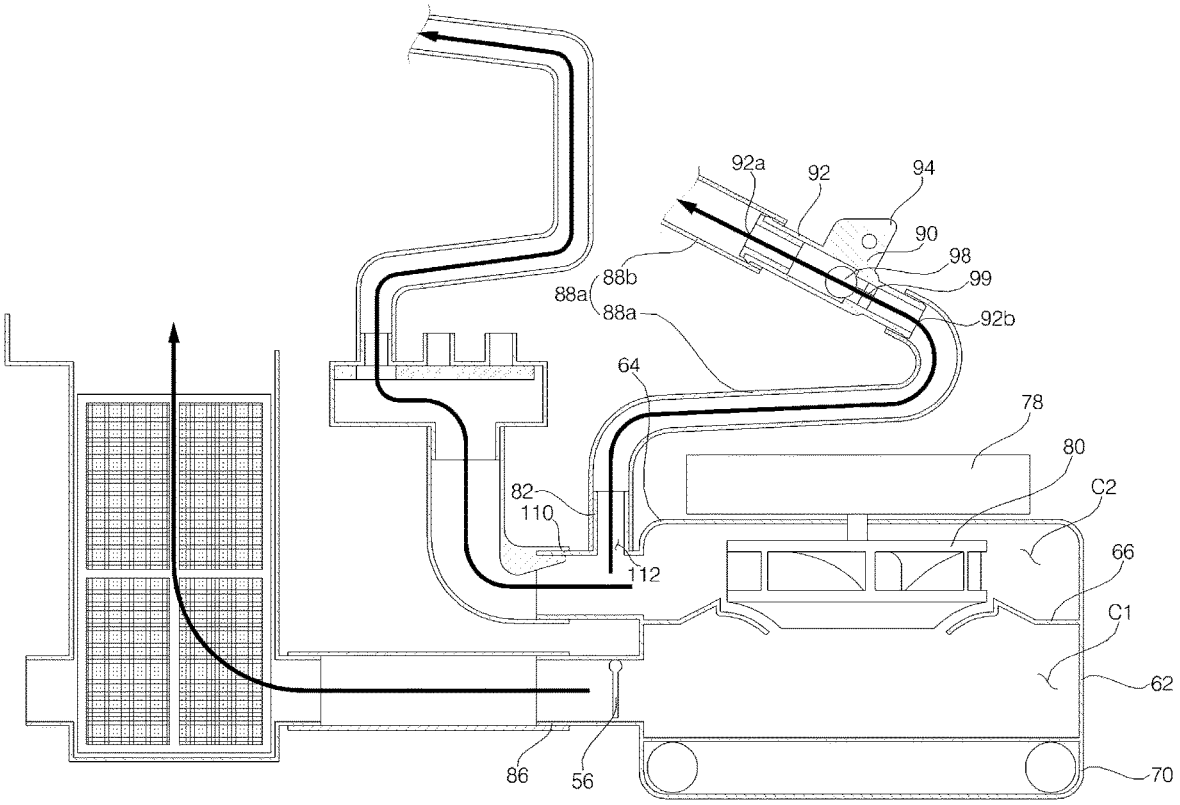
FIG. 5 is a view for explaining a sump, a switching valve, and a steam nozzle connected to a washing pump according to an embodiment of the present invention.
Figure 6:
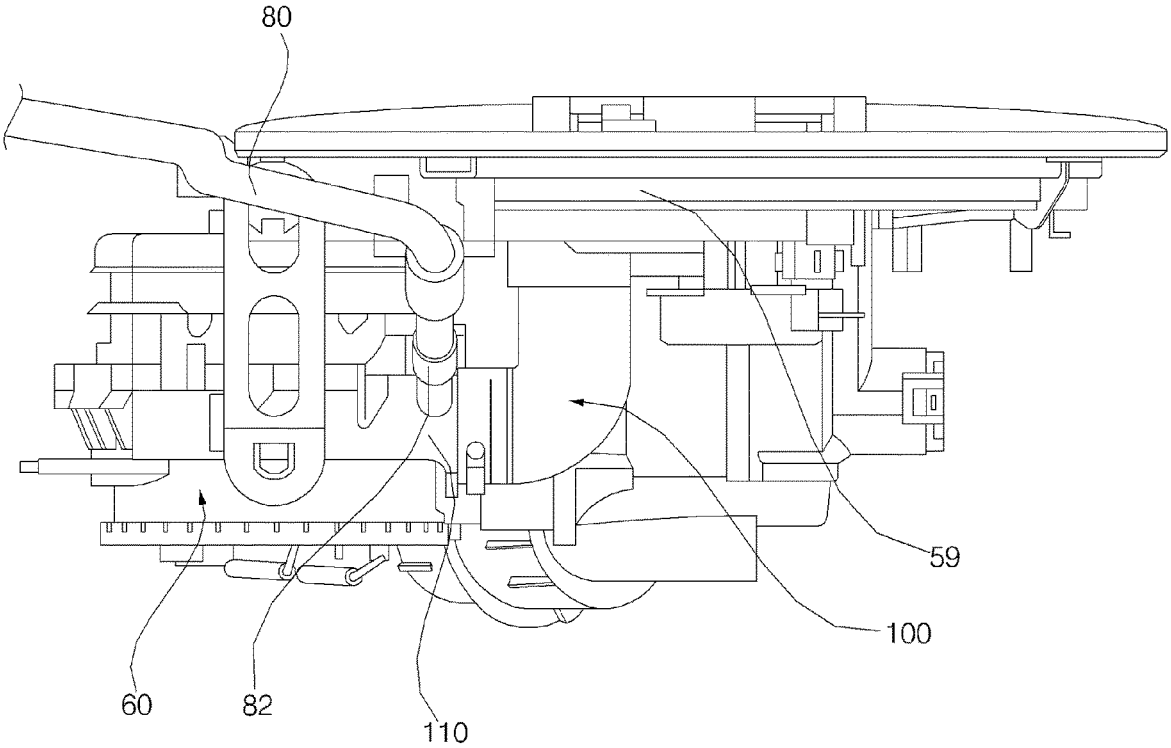
FIG. 6 is a view for explaining a configuration and an arrangement of a washing pump and a washing water supply pipe according to an embodiment of the present invention.
Figure 7:
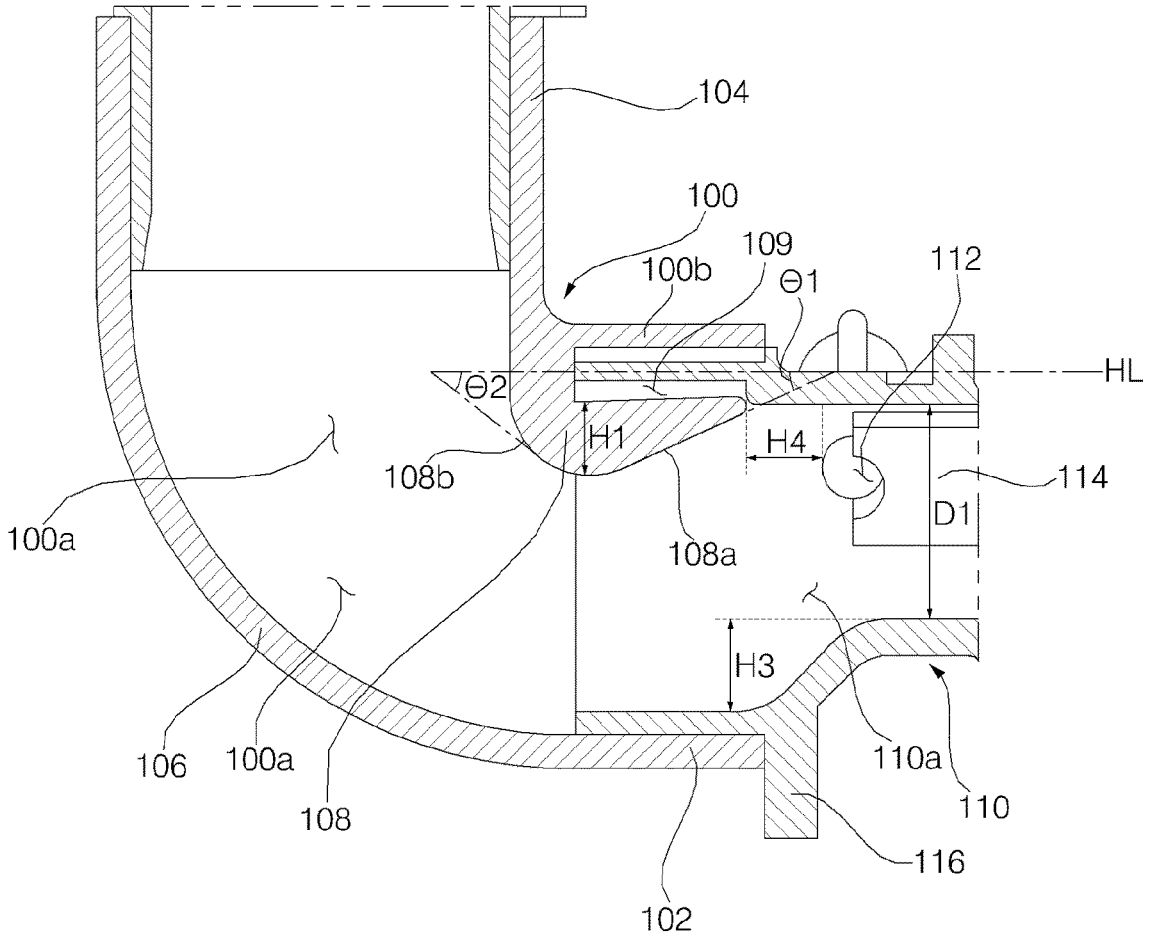
FIG. 7 is a cross-sectional view illustrating an internal configuration and arrangement of a washing water outflow pipe and a washing water supply pipe according to an embodiment of the present invention.
Figure 8A:
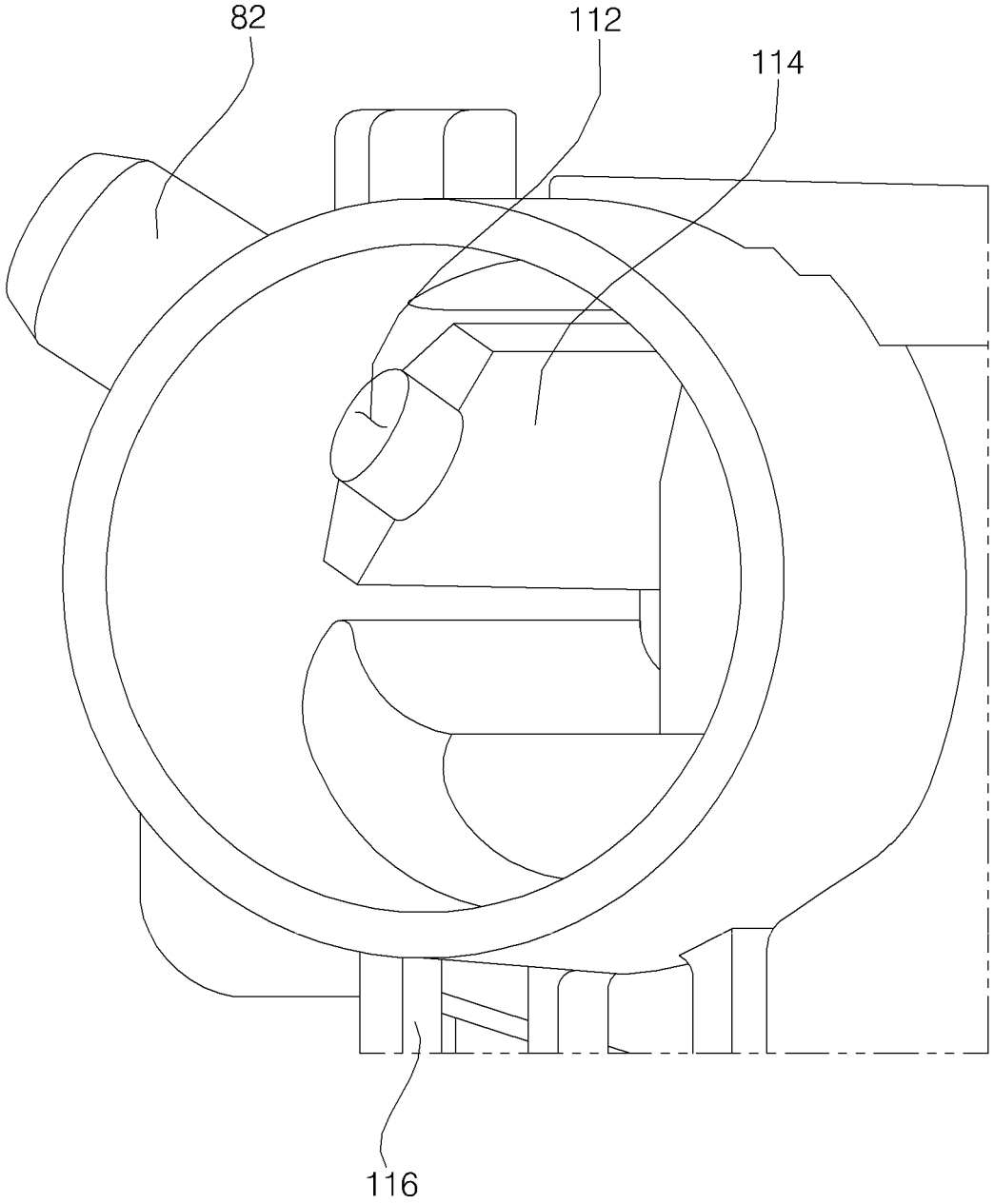
FIG. 8A is a perspective view of a washing water outflow pipe of a washing pump according to an embodiment of the present invention.
Figure 8B:
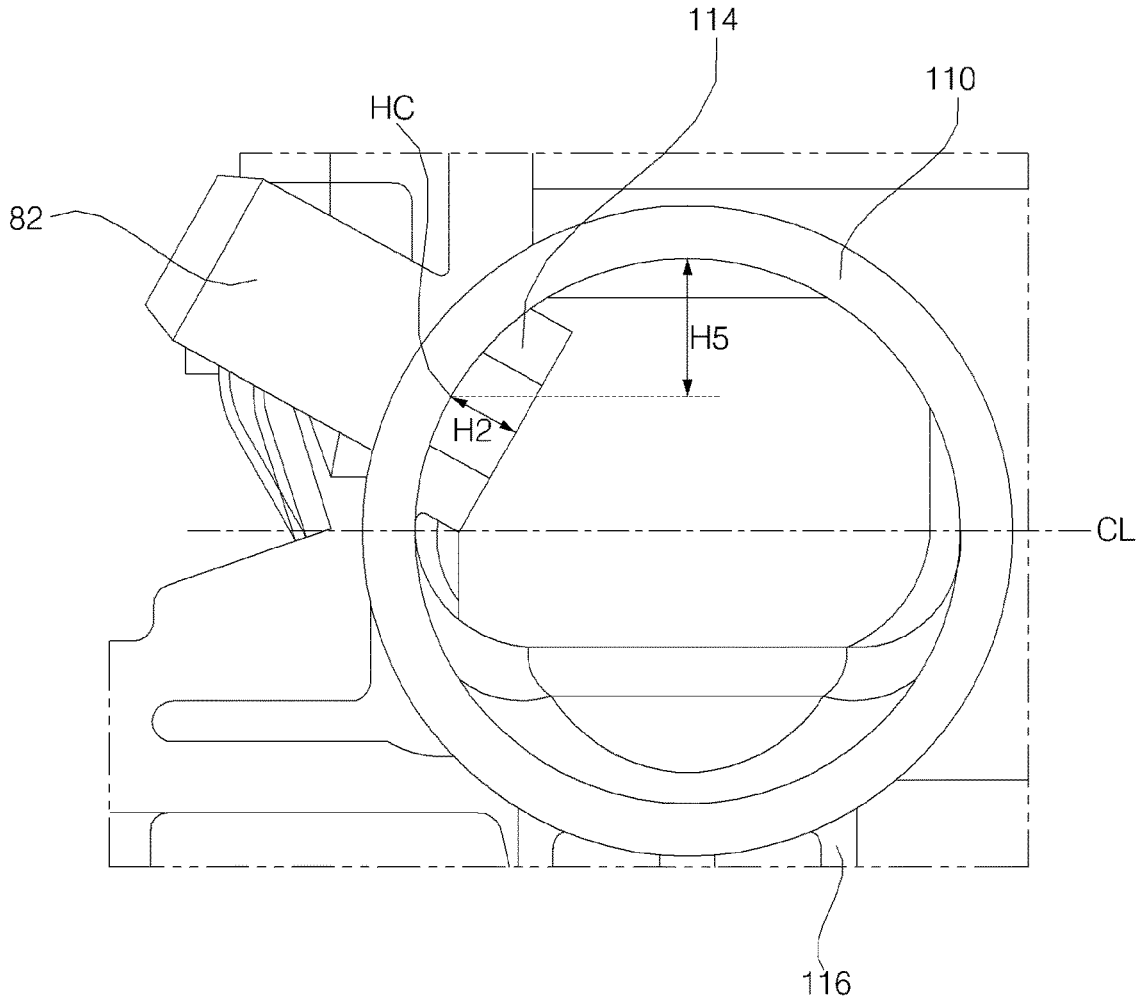
FIG. 8B is a front view of a washing water outflow pipe of a washing pump according to an embodiment of the present invention.
Figure 9A:
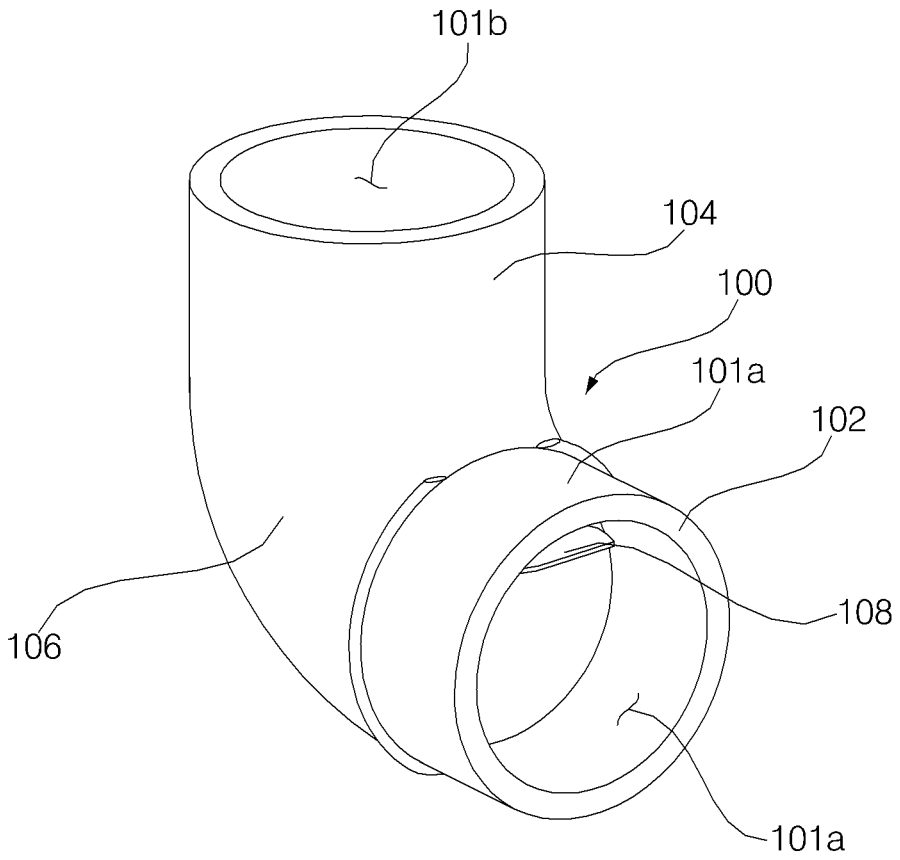
FIG. 9A is a perspective view of a washing water supply pipe according to an embodiment of the present invention.
Figure 9B:
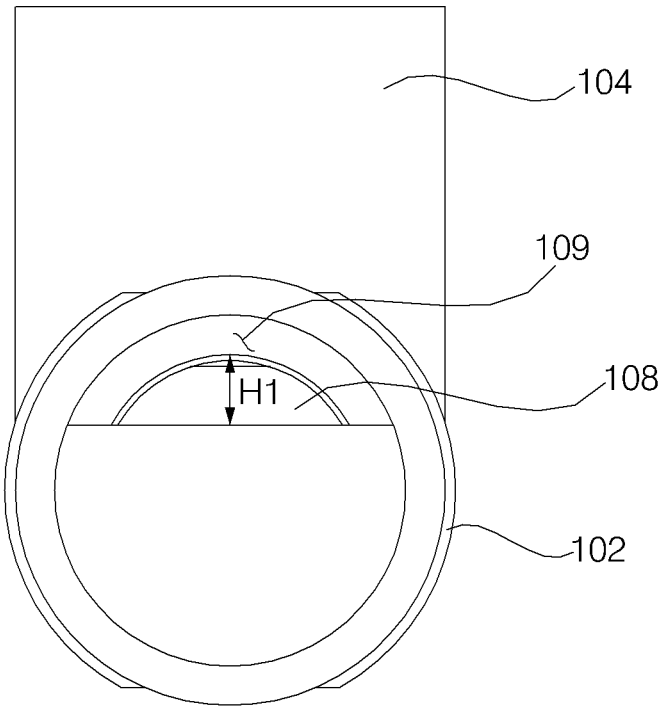
FIG. 9B is a front view of a washing water supply pipe according to an embodiment of the present invention.
Figure 9C:
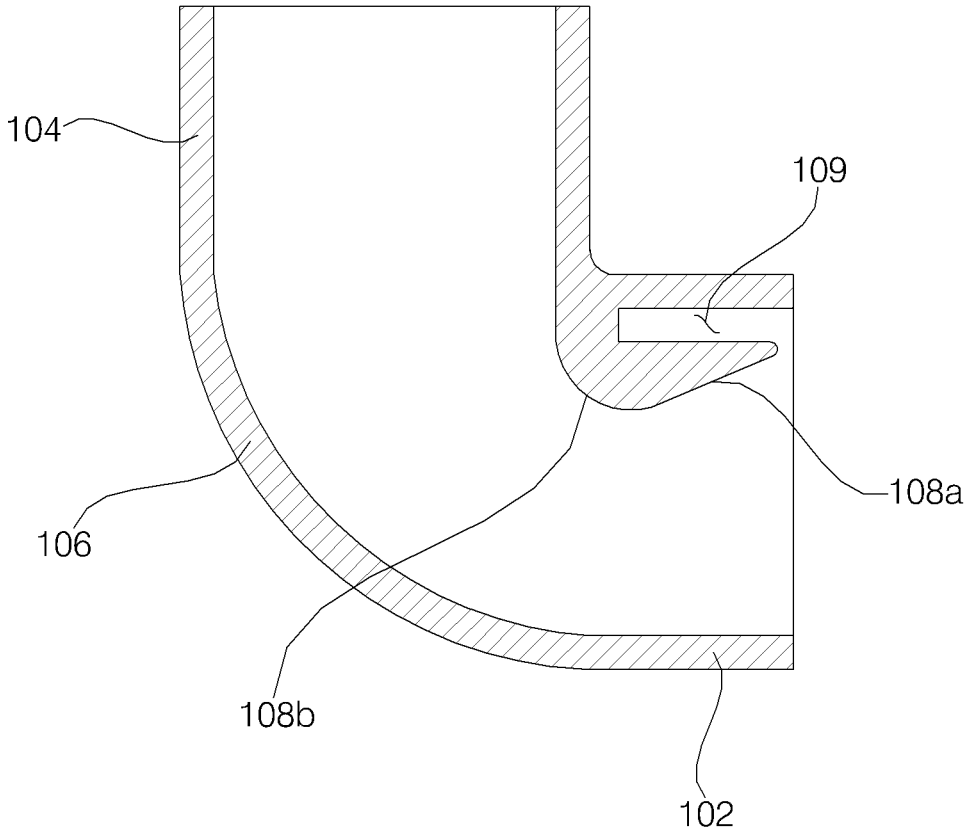
FIG. 9C is a cross-sectional view of a washing water supply pipe according to an embodiment of the present invention.

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, a dishwasher according to embodiments of the present invention will be described with reference to the drawings.

<Overall Configuration>

A dishwasher 10 according to the present embodiment includes a case 12 forming an outer shape of the dishwasher 10, a tub 16 forming a washing chamber 16*a* that is provided in the case 12 and accommodates a washing target, a door 14 that is provided in the front surface of the tub 16 and opens and closes the washing chamber 16*a*, and a sump 40 that is disposed below the tub 16 and stores washing water.

The sump 40 according to the present embodiment may be provided with a filter 42 for filtering the washing water supplied from the outside or the washing water introduced from the tub 16.

The dishwasher 10 according to the present embodiment includes a plurality of spray nozzles 20, 22, and 24 for spraying washing water into the washing chamber 16*a* inside the tub 16, a washing pump 60 for supplying the washing water stored in the sump 40 to the plurality of spray nozzles 20, 22, and 24, a switching valve 59 for connecting the washing water supplied from the washing pump 60 to at least one of the plurality of spray nozzles, and a rack 30, 32 for holding a washing target in the tub 16.

The rack 30*a*, 30*b* according to the present embodiment may have a structure for holding a washing target so as to wash the washing target with the washing water sprayed by the plurality of the spray nozzles 20, and may include an upper rack 30*a* disposed in an upper side and a lower rack 30*b* disposed in a lower side based on a disposed position inside the washing chamber 16*a*.

The plurality of spray nozzles 20, 22, and 24 may be disposed in the vertical direction. The plurality of spray nozzles 20, 22, and 24 according to the present embodiment includes a lower spray nozzle 20 that is disposed in the lowermost end and sprays washing water from the lower side to the upper side toward the lower rack 30*b*, an upper spray nozzle 22 that is disposed between the upper rack 30*a* and the lower rack 30*b* and sprays washing water toward the upper rack 30*a* or the lower rack 30*b* and the upper rack 30*a*, and a top spray nozzle 24 disposed in an upper end of the washing chamber 16*a* which is the upper side of the upper rack 30*a* and spraying washing water into a space of the washing chamber 16*a*. The plurality of spray nozzles 20, 22, and 24 may be supplied with the washing water from the washing pump 60 through a plurality of spray nozzle connecting pipes 20*a*, 22*a*, and 24*a*.

The switching valve 59 may selectively supply the washing water pumped by the washing pump 60 to at least one of the lower spray nozzle 20, the upper spray nozzle 22, and the top spray nozzle 24. The switching valve 59 may selectively connect a washing water supply pipe 100 through which the washing water discharged from the washing pump 60 flows to at least one of the plurality of spray nozzle connecting pipes 20*a*, 22*a*, and 24*a*.

The washing pump 60 may be connected to the sump 40 through a water collecting pipe 54 in which a water collecting flow path is formed. A check valve 56 for opening and closing a connection between the sump 40 and the washing pump 60 may be disposed in the water collecting pipe 54 or the inlet of the washing pump 60.

The check valve according to the present embodiment may be opened when the washing pump 60 is operated to flow the washing water, and may be closed when the washing pump 60 stops and the washing water does not flow. The check valve may be opened by the flow pressure of the washing water of the washing pump 60. However, the above-mentioned check valve is just an example, and the check valve can be constituted by a solenoid valve which is opened or closed by an electronic signal.

The dishwasher 10 according to the present embodiment may include a water supply assembly for supplying washing water into the dishwasher and a drain assembly for draining water stored inside the dishwasher. The water supply assembly according to the present embodiment includes a water supply pipe 44 forming a water supply flow path for supplying washing water from an external water source, a water supply valve 46 for opening and closing a water supply flow path formed in the water supply pipe 44, and a flow meter 48 for measuring the flow rate of the washing water flowing to the sump 40 through the water supply flow path.

The drain assembly according to the present embodiment may include a drain pipe 50 in which a drain flow path for guiding the water stored in the sump 40 to the outside is formed, and a drain pump 52 which is disposed in the drain flow path formed in the drain pipe 50, and drains the washing water in the sump 40 to the outside. The drain pump may include a drain motor (not shown) for generating a rotational force.

<Washing Pump>

The washing pump 60 according to the present embodiment may supply water stored in the sump 40 to the plurality of spray nozzles 20, 22 and 24, or generate steam to send to a steam nozzle 32. The washing pump 60 according to the present embodiment is connected to the sump 40 through the water collecting pipe 54. The washing pump 60 according to the present embodiment is connected to the switching valve and the spray nozzle through the washing water supply pipe 100 and may be connected to the steam nozzle 32 through a steam supply pipe 88.

The washing pump 60 according to an embodiment of the present invention includes a washing pump housing 62 that is coupled to the sump 40 and forms an external shape, an impeller 80 that is disposed inside the washing pump housing 62 and forms a flow of washing water or steam disposed inside the washing pump housing 62, a washing motor 78 that rotates the impeller 80, and a heater 70 that generates steam by heating washing water in the washing pump housing 62.

The washing pump housing 62 according to the present embodiment may be provided with a washing water inflow pipe 86 which forms an inflow port so that the washing water of the sump 40 flows into the washing pump housing 62 by the rotation of the impeller 80, a washing water outflow pipe 110 which forms an outflow port so that the washing water inside the washing pump housing 62 is supplied to the plurality of spray nozzles 20, 22 and 24, and a steam discharge pipe 82 which is disposed in the washing water outflow pipe 110 and forms a steam discharge port 112 through which the steam generated by the heater 70 is discharged.

The washing water inflow pipe 86 may be disposed in a lower portion of the circumferential surface of the washing pump housing 62, and the washing water outflow pipe 110 may be disposed in an upper portion of the circumferential surface of the washing pump housing 62. The washing water outflow pipe 110 according to the present embodiment forms an outflow path 110*a* formed in a horizontal direction therein.

The washing pump housing 62 may be formed in a cylindrical shape having open top and bottom surfaces. A housing cover 64 is coupled to the upper end of the washing pump housing 62, and the heater 70 is coupled to the lower end thereof. The housing cover 64 may cover the open upper portion of the washing pump housing 62. The washing motor 78 for generating a rotational force to rotate the impeller 80 may be disposed in the upper side of the housing cover 64.

Inside the washing pump housing 62, a partition wall 66 dividing the inner space of the washing pump housing 62 into upper and lower parts is disposed. The partition wall 66 according to the present embodiment may be disposed below the impeller 80. The partition wall 66 may be disposed in the upper side of the washing water inflow pipe 86 and disposed in the lower side of the washing water outflow pipe 110. The partition wall 66 may divide the inside of the washing pump housing 62 into a lower chamber C1 and an upper chamber C2. The lower chamber C1 is a place where the negative pressure is generated by the rotation of the impeller 80, and the upper chamber C2 is a place where the positive pressure is generated by the rotation of the impeller 80.

The lower chamber C1 is connected to the sump 40 through the washing water inflow pipe 86. The upper chamber C2 is connected to the switching valve 59 through the washing water outflow pipe 110 and the washing water supply pipe 100. The steam discharge pipe 82 formed in one side of the washing water outflow pipe 110 may be connected to the steam nozzle 32 through the steam supply pipe 88.

The washing pump 60 may be divided, based on the partition wall 66, into a pump lower portion 60*a* through which the washing water is introduced by the rotation of the impeller 80, and a pump upper portion 60*b* through which the washing water is discharged by the rotation of the impeller 80.

The lower chamber C1 is formed inside the pump lower portion 60*a*, and the upper chamber C2 is formed inside the pump upper portion 60*b*. In the pump lower portion 60*a*, the washing water inflow pipe 86 and the heater 70 are disposed. The washing water outflow pipe 110 and the steam discharge pipe 82 are disposed in the pump upper portion 60*b*. The housing cover 64 is disposed in the pump upper portion 60*b*. In the pump upper portion 60*b*, the impeller 80 is disposed inside the washing pump housing 62 and the washing motor 78 is disposed in the upper side of the washing pump housing 62.

The partition wall 66 is formed with a partition hole 66*a* for communicating the lower chamber C1 with the upper chamber C2. The upper surface of the partition wall 66 is formed in a volute shape so that the washing water introduced into the upper chamber C2 through the partition hole 66*a* from the lower chamber C1 may be guided to the washing water outflow pipe 110. A lower surface of the partition wall 66 may be formed with a guider (not shown) protruding downward. The guider of the partition wall 66 may guide the washing water introduced into the lower chamber C1 to the partition wall hole 66*a* through the washing water inflow pipe 86. The guider of the partition wall 66 allows the washing water in the lower chamber C1 to be uniformly heated by the heater 70.

The impeller 80 is rotated by the washing motor 78 to flow washing water or steam in the washing pump housing 62 and discharge it to the outside. The impeller 80 is rotatably disposed in the upper chamber C2. The impeller 80 may transfer the washing water or steam introduced into the upper chamber C2 from the lower chamber C1 through the partition wall hole 66*a* to the washing water outflow pipe 110 or the steam discharge pipe 82.

The washing water inflow pipe 86 is connected to the lower chamber C1 side of the washing pump housing 62. The washing water inflow pipe 86 is connected to the water collecting pipe 54 so that the washing water of the sump 40 can be introduced into the lower chamber C1. The washing water inflow pipe 86 is disposed to protrude from the lower portion of the circumference surface of the washing pump housing 62.

The washing water outflow pipe 110 is connected to the upper chamber C2 side of the washing pump housing 62. The washing water outflow pipe 110 is connected to the washing water supply pipe 100 so that the washing water in the upper chamber C2 can be discharged to the washing water supply pipe 100. The washing water outflow pipe 110 is disposed to protrude outward from the upper portion of the circumference surface of the washing pump housing 62.

The steam discharge pipe 82 is connected to the upper chamber C2 side of the washing pump housing 62. The steam discharge pipe 82 may be disposed in various positions of the washing pump housing 62 so as to connect the upper chamber C2 of the washing pump housing 62 with the steam supply pipe 88. In the present embodiment, the steam discharge pipe 82 is disposed in the washing water outflow pipe 84. The pipe direction of steam discharge pipe 82 according to the present embodiment is disposed to be inclined in such a manner that the steam discharge direction is inclined upward. The steam discharge direction of the steam discharge pipe 82 may be perpendicular to the discharge direction of the washing water of the washing water outflow pipe 84.

The steam discharge pipe 82 discharges the steam or the high-temperature washing water generated inside the washing pump housing 62 by the heater 70 to the steam supply pipe 88. The steam supply pipe 88 is connected to the upper chamber C2 through the steam discharge pipe 82.

The heater 70 is connected to the lower end of the washing pump housing 62 and forms the bottom surface of the washing pump housing 62. The heater 70 may heat the washing water flowing inside the washing pump housing 62 and generate the high-temperature washing water or steam. When the heater 70 heats the washing water inside the washing pump housing 62, the impeller 80 can be rotated or stopped. The heater 70 is disposed below the washing water inflow pipe 86. The heater 70 is disposed below the partition wall 66. A part of the heater 70 is disposed inside the washing pump housing 62.

The check valve 56 according to the present embodiment is disposed in the washing water inflow pipe 86. The upper end of the check valve 56 is coupled to the upper end of the washing water inflow pipe 86. The check valve 56 may be opened when the impeller 80 rotates, and may be closed when the impeller 80 does not rotate. The check valve 56 may be opened during operation of the washing motor 78, and closed during the stop of the washing motor 78. The check valve 56 may be closed during the steam generation of the heater 70 to prevent the steam generated inside the washing pump housing 62 from flowing out to the sump 40 through the lower chamber C1 and the washing water inflow pipe 86.

The check valve 56 may be configured to allow washing water to flow from the wash pump 60 to the sump 40 during operation of the drain pump 52. The check valve 56 may be formed in such a manner that a part of the lower portion of the washing water inflow pipe 86 is opened when the check valve 56 is closed. The check valve 56 is formed to cover 50% to 90% of the cross-sectional area of the washing water inflow pipe 86 when the check valve 56 is closed, and is preferably formed to cover 70% of the cross-sectional area of the washing water inflow pipe 86.

The check valve 56 may be closed to prevent the washing water and steam from flowing to the sump 40 from the washing pump 60 during steam generation of the heater 70. However, the check valve 56 may be opened by the flow pressure of the washing water when the impeller 80 rotates, during steam generation of the heater 70.

When the drain pump 52 and the washing motor 78 are stopped (when not operated), the check valve 56 stores the washing water inside the washing pump housing 62.

The heater 70 according to an embodiment of the present invention includes a heater cover 72 that forms a bottom surface of the washing pump housing 62, a heating element 74 joined to the lower side of the heater cover 72 to heat the heater cover 72, and a heater plate 76 which is joined to the lower side of the heater cover 72 and transfers the heat generated by the heating element 74 to the heater cover 72. Unlike the present embodiment, the heater plate 76 can be disposed below the heater.

The heater 70 according to the present embodiment includes a thermostat (not shown) for supplying power to the heating element 74 and adjusting the temperature of the heater 70, a wire (not shown) for electrically connecting the heating element 74 and the thermostat, and a heater shield (not shown) for covering a part of the heater plate 76 from below.

The dishwasher 10 according to the present embodiment is provided with the steam supply pipe 88 connecting the steam nozzle 32 and the washing pump 60, and a selector valve 90 that is disposed in the steam supply pipe 88, blocks the outflow of the washing water exceeding a first set pressure, and permits the discharge of the washing water or steam having a second set pressure or lower.

<Regarding Washing Water and Steam Flow Path>

The washing water flowing in the dishwasher according to the present embodiment flows through the sump 40 and the tub 16, and may wash washing target. Further, the washing water stored in the sump 40 may be supplied from the external water source through a water supply assembly, and may be discharged to the outside through a drain assembly.

The washing water stored in the sump 40 may flow into the tub 16 by rotating the impeller 80 by the washing motor 78 of the washing pump 60. That is, by the operation of the washing motor 78, the washing water in the sump 40 flows into the washing pump 60, and pumped to the switching valve 59 from the washing pump 60, thereby flowing to at least one of the plurality of spray nozzles 20, 22, 24.

The washing water stored in the sump 40 flows into the washing pump housing 62 through the washing water inflow pipe 86 formed in the washing pump housing 62 of the washing pump 60. In addition, it may flow to the switching valve 59 outside the washing pump housing 62 through the washing water outflow pipe 110 formed in the washing pump housing 62.

The sump 40 and the washing pump 60 are connected through the water collecting pipe 54, and the washing pump and the switching valve 59 are connected through the washing water supply pipe 100. The switching valve 59 may be connected to the plurality of spray nozzles 20, 22, and 24 through each connecting pipe 20*a*, 22*a* and 24*a*. The switching valve 59 supplies the washing water pumped by the washing pump 60 to at least one spray nozzle.

The washing water sprayed to the tub 16 through the spray nozzle may be introduced into the sump 40 through a hole formed in a bottom 16*b* of the tub 16.

The steam flowing in the dishwasher according to the present embodiment is generated in the washing pump 60. By operating the heater 70, the washing water existing in the washing pump housing 62 of the washing pump 60 may be generated into steam. In this case, it is preferable to minimize the flow of washing water inside the washing pump 60. Therefore, it is preferable to stop the operation of the washing motor 78 or rotate the impeller 80 at a set rotation speed or lower.

The steam generated in the washing pump 60 may flow into the steam discharge pipe 82 formed in one side of the washing water outflow pipe 110.

The steam generated in the washing pump 60 may flow through the sump 40 through the cleaning inflow inlet 86. The washing water inflow pipe 86 according to the present embodiment is disposed below the circumferential surface of the housing, and the washing water outflow pipe 110 is disposed above the circumferential surface of the housing, so that most steam generated in the washing pump 60 can be discharged to the washing water outflow pipe 110.

The steam generated in the washing pump 60 may be supplied to the plurality of spray nozzles through the washing water outflow pipe 110. Since the steam discharge pipe 82 is disposed in one side of the washing water outflow pipe 110, the steam may be discharged to each of the spray nozzles. In order to minimize this, the switching valve 59 may connect to the top spray nozzle 24 disposed in the uppermost end of the washing chamber 16*a*. In the case of a flow path pipe 24*c* connected to the top spray nozzle 24, since the length of the flow path is long and the cross section of the flow path is narrow, a flow path resistance is formed to be larger than other flow path pipe 24*a*, 24*b*, so that the steam generated in the washing pump 60 can flow into the steam discharge pipe 82.

The steam discharge pipe 82 may be connected to the steam nozzle 32 through the steam supply pipe 88. The steam supply pipe 88 according to the present embodiment may be provided with a selector valve 90 which blocks the flow of the washing water at a set pressure or higher, and permits the discharge of washing water or steam below the set pressure.

The selector valve 90 according to the present embodiment may be opened or closed based on the rotational speed of the impeller 80 rotated by the washing motor 78. That is, the selector valve 90 may be closed when the impeller 80 rotates at a speed is equal to or higher than the set rotational speed, and the selector valve 90 may be opened when the impeller 80 rotates less than the set rotational speed. Therefore, even when the washing motor 78 is not operated, the selector valve 90 maintains the open state.

The selector valve 90 according to the present embodiment may be opened or closed depending on the position of the valve ball 98. That is, the selector valve 90 according to the present embodiment is disposed such that an inlet for introducing steam or washing water is disposed lower than an outlet for discharging steam or washing water, and the valve ball 98 may open and close the steam supply pipe 88 while moving up and down inside the selector valve 90.

The selector valve 90 according to the present embodiment includes a valve body 92 in which a valve flow path 92*a* is formed therein, a valve ball 98 disposed inside the valve body 92 and moving inside the valve flow path 92*a* to close the valve flow path, and a plurality of valve ribs 99, which are radially protruded from the inner surface of the valve body 92 so that the valve ball 98 is seated, formed inside the inlet side. The valve rib 99 is formed in the lower end of the valve flow path 92*a*, so that steam or washing water can flow into the valve flow path 92*a*, even if the valve ball 98 is seated.

That is, when washing water having a set pressure or higher flows into the valve body 92, the valve ball 98 is disposed in the upper end of the valve flow path 92*a* to close the valve flow path 92*a*. In addition, when washing water having a pressure lower than the set pressure is introduced into the valve body 92, the valve ball 98 may be seated in the valve rib 99 or disposed between the upper end and the lower end of the valve flow path 92*a*, thereby not closing the valve flow path 92*a*.

Therefore, when the impeller 80 rotates at a set rotation speed or higher, the selector valve 90 is closed, so that the washing water pumped by the washing pump 60 is supplied to the plurality of spray nozzles 20, 22, 24. Further, when the impeller 80 rotates below the set rotational speed, the selector valve 90 is opened, so that the steam generated in the washing pump 60 can be supplied to the steam nozzle 32.

However, since the steam discharge pipe 82 is branched from the washing water outflow pipe 110, the steam generated in the washing pump 60 is supplied to the steam nozzle 32 along the steam discharge pipe 82, and may be supplied to at least one of the plurality of spray nozzles 20, 22, 24 while flowing along the washing water outflow pipe 110.

Hereinafter, the structure and arrangement of the washing water outflow pipe 110, the steam discharge pipe 82, and the washing water supply pipe 100 for maximizing the flow of the steam generated in the washing pump 60 to the steam discharge pipe 82 and minimizing the steam flowing into the washing water supply pipe 100 through the washing water outflow pipe 110 will be described.

<Configuration and Arrangement of Washing Water Outflow Pipe, Steam Discharge Pipe, Washing Water Supply Pipe>

The steam discharge pipe 82 according to the present embodiment forms the discharge port 112 in the outer circumferential surface of the washing water outflow pipe 110 and is vertically protruded outside the circumferential surface 111 of the washing water outflow pipe 110. The steam discharge pipe 82 according to the present embodiment forms the discharge port 112 communicating with the outside in one side of the circumferential surface 111 of the washing water outflow pipe 110. The steam discharge pipe 82 according to the present embodiment is protruded outward from the circumferential surface 111 of the washing water outflow pipe 110 having the discharge port 112 formed therein.

The steam discharge pipe 82 is formed in an upwardly inclined direction in the circumferential surface of the washing water outflow pipe 110. When the upper side is classified as an upper portion and the lower side is classified as a lower portion based on a virtual center line CL passing the washing water outflow pipe 110 at a half height of the cross section, the steam discharge pipe 82 is disposed in an upper portion of the washing water outflow pipe 110. That is, the steam discharge pipe 82 is formed in an upward surface among the circumferential surface 111 of the washing water outflow pipe 110 in which the outflow path 110*a* is formed horizontally. That is, the steam discharge pipe 82 is formed in a position equal to or higher than half the length of the washing water outflow pipe 110 vertically formed.

Since the steam generated in the washing pump housing 62 has a smaller specific gravity than the washing water, it flows to the upper side of the outflow path 110*a* when moving the washing water outflow pipe 110, so that the steam discharge pipe 82 may be formed in the upper side of the circumferential surface of the washing water outflow pipe 110.

A second protrusion 114 for preventing the washing water flowing in the outflow path 110*a* from flowing into the steam discharge pipe 82 is disposed inside the washing water outflow pipe 110 according to the present embodiment. The second protrusion 114 protrudes into the washing water outflow pipe 110 around the discharge port 112. The second protrusion 114 is formed in the upstream side of the washing water outflow pipe 110 in the discharge port 112.

The second protrusion 114 may cover the flow of washing water, which flows by the impeller 80 in the washing pump 60,) to the discharge port 112. Further, the second protrusion 114 may have an air trap, formed around the discharge port 112, that protrudes inward from the upstream and downstream sides of the washing water outflow pipe 110, based on the first protrusion 108 and the discharge port 112 described below, and suppresses the flow of the steam.

The outflow path 110*a* formed in the inside of the washing water outflow pipe 110 according to the present embodiment may include an extension portion 110*b* in which the flow path is extended from a point where the discharge port 112 is formed. The lower portion of the outflow path 110*a* formed in the inside of the washing water outflow pipe 110 according to the present embodiment may be extended downward from the point where the discharge port 112 is formed.

The end of the washing water outflow pipe 110 according to the present embodiment may include a fastening part 110*c* inserted into the washing water supply pipe 100. The fastening part 110*c* is inserted into the washing water supply pipe 100 to connect the washing water outflow pipe 110 and the washing water supply pipe 100. A part of the upper portion of the fastening part 110*c* is inserted into an insertion groove 109 formed between the outer circumferential surface 100*b* of the washing water supply pipe 100 and the first protrusion 108.

The lower side of the washing water outflow pipe 110 according to the present embodiment may further include a stopper 116 for restricting the length of the washing water outflow pipe 110 inserted into the washing water supply pipe 100.

The stopper 116 according to the present embodiment protrudes from the lower side of the circumference surface of the washing water outflow pipe 110 toward the outer side of the circumference surface of the washing water outflow pipe 110. The stopper 116 according to the present embodiment may be formed between the extension portion 110*b* of the washing water outflow pipe 110 and the fastening portion 110*c*.

The size of the cross-sectional area of the outflow path 110*a* formed in the inside of the washing water outflow pipe 110 may increase toward the downstream from a portion where the discharge port 112 connected to the steam supply pipe 88 is formed. The cross-sectional area of the flow path in the outflow path 110*a* formed in the inside of the washing water outflow pipe 110 may increase in a section where the extension portion 110*b* is formed.

The cross-sectional area of the flow path in the outflow path 110*a* formed in the inside of the washing water outflow pipe 110 is reduced in a section where the first protrusion 108 is disposed. The cross-sectional area of the flow path in the outflow path 110*a* formed in the inside of the washing water outflow pipe 110 may be reduced in a section where the fastening part 110*c* is formed.

The height H1 of the first protrusion 108 protruding to the inside of the outflow path 110*a* formed in the inside of the washing water outflow pipe 110 may be set to be less than or equal to the length H3 of the cross section of the extension portion 110*b* extended to the lower side of the outflow path 110*a* formed in the washing water outflow pipe 110. The height H1 of the first protrusion 108 protruding to the inside of the outflow path 110*a* formed in the inside of the washing water outflow pipe 110 may be set to be larger than the height H1 of the second protrusion 114 protruding from the discharge port 112 formed in the washing water outflow pipe 110 to the inside of the outflow path 110*a*.

The washing water supply pipe 100 according to the present embodiment connects the switching valve 59 disposed in the upper side with the washing water outflow pipe 110 disposed in the lateral surface. The washing water supply pipe 100 is formed in such manner that the direction in which an inlet end 101*a* is oriented and the direction in which an outlet end 101*b* is oriented are perpendicular to each other.

The washing water supply pipe 100 according to the present embodiment includes a horizontal pipe portion 102 connected to the washing water outflow pipe 110, a vertical pipe portion 104 connected to the switching valve 59 and formed perpendicularly to the horizontal pipe portion 102, and a bending pipe portion 106 connecting the horizontal pipe portion 102 and the vertical pipe portion 104. The vertical pipe portion forms a flow path in the upward direction, and is fastened to the switching valve 59. The horizontal pipe portion 102 forms a flow path in a direction perpendicular to the upper direction in which the vertical pipe portion 104 forms a flow path, and is fastened to the washing water outflow pipe 110.

The end of the switching valve 59 may be fastened to the washing water supply pipe 100 in such a manner that it is inserted into the vertical pipe portion 104. The end of the washing water outflow pipe 110 may be fastened to the washing water supply pipe 100 in such a manner that it is inserted into the horizontal pipe portion 102.

The washing water supply pipe 100 according to the present embodiment includes a first protrusion 108 which protrudes inward from the upper portion and covers the upper side of the flow path. The first protrusion 108 is formed to protrude inward from the upper side of the flow path formed by the horizontal pipe portion 102. The first protrusion 108 may form an air trap around the discharge port 112 that is disposed downstream of the discharge port 112 of the steam discharge pipe 82 to suppress the steam flowing in the washing water outflow pipe 110

Further, the second protrusion 114 may have an air trap, formed around the discharge port 112, that protrudes inward from the upstream and downstream sides of the washing water outflow pipe 110, based on the first protrusion 108 and the discharge port 112 described below, and suppresses the flow of the steam.

The first protrusion 108 has a front surface 108*a* that forms an inclination so as to face the washing water flowing in the outflow path 110*a* formed in the washing water outflow pipe 110, and a rear surface 108*b* that forms an inclination opposite to the front surface 108*a* in the downstream of the front surface 108*a*. The inclination angle $\theta_1$ of the front surface 108*a* with respect to the virtual horizontal line HL formed along the upper end of the washing water outflow pipe 110 may be formed gentler than the inclination angle $\theta_2$ formed by the rear surface 108*b*. Accordingly, the first protrusion 108 may restrict the flow of steam while not hindering the flow of the washing water as far as possible.

The first protrusion 108 is disposed in the end of the outflow path 110*a* formed in the washing water outflow pipe 110. The first protrusion 108 is formed in a point where the extension portion 110*b* where the outflow path 110*a* extends downward is ended.

The distance H4 from the discharge port 112 to the first protrusion 108 may be less than half the length D1 of the outflow path 110*a* formed in the washing water outflow pipe 110. The height H1 of the first protrusion 108 protruding downward from the upper end of the outflow path 110*a* may be formed longer than the length H5 of the center 112 of the discharge port 112 spaced from the inner upper end of the outflow path 110*a*.

An insertion groove 109 into which the washing water outflow pipe 110 is inserted is formed between the outer circumferential surface 100*b* formed by the horizontal pipe portion 102 and the first protrusion 108. The end of the washing water outflow pipe 110 is inserted into the insertion groove 109 and may be fastened to the washing water supply pipe 100.

According to the dishwasher of the present invention, one or more of the following effects can be obtained.

First, in a structure that the washing water and the steam are discharged through a single washing water outflow pipe in the washing pump, the steam discharge pipe is formed upward from one side of the washing water outflow pipe, the steam and the washing water discharged from the washing pump can be separately supplied to the steam nozzle and the spray nozzle respectively. That is, in consideration of the characteristic that the steam flows to the upper side of the washing water, steam can be supplied through the steam nozzle, and the washing water can be smoothly supplied into the tub through the spray nozzle.

Further, in the present invention, the first protrusion is disposed in the downstream of the discharge port of the steam discharge pipe, and restricts the flow of steam flowing upward from the periphery of the discharge port, thereby actively providing steam to the steam nozzle.

Second, the outflow path of the washing water outflow pipe extends downward from a point where the discharge port is formed, and the first protrusion is formed to have a small inclination angle of the front surface facing the flowing washing water, so that the steam can flow well to the discharge pipe while the flow of the washing water is not disturbed.

Third, a second protrusion is provided in the upstream of the discharge port of the steam discharge pipe to restrict the flow of the washing water to the steam discharge pipe, and the first protrusion and the second protrusion form an air trap around the discharge port, so that steam supply to the discharge port becomes active.

Fourth, the steam supply pipe in which the first protrusion is formed is provided with an insertion groove between the outer circumferential surface and the first protrusion, and the washing water discharge pipe is inserted into the insertion groove, so that the fastening structure of the washing water discharge pipe and the washing water supply pipe is strengthened.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A dishwasher comprising:

a tub that defines a washing chamber configured to accommodate one or more washing targets;

a sump disposed vertically below the tub and configured to store washing water therein;

a plurality of spray nozzles configured to spray washing water in the sump to the washing chamber;

a steam nozzle configured to supply steam to the washing chamber;

a washing pump housing that is coupled to the sump and that is configured to receive washing water from the sump, the washing pump housing being configured to be connected to the plurality of spray nozzles or the steam nozzle;

a heater configured to heat washing water in the washing pump housing to thereby generate steam;

a washing motor configured to rotate an impeller to cause flow of washing water in the washing pump housing or steam generated by the heater;

a washing water outflow pipe that protrudes outward from one side of a circumferential surface of the washing pump housing, the washing water outflow pipe defining an outflow path configured to supply washing water in the washing pump housing to the plurality of spray nozzles or steam in the washing pump housing to the steam nozzle;

a steam discharge pipe that protrudes outward from a circumferential surface of the washing water outflow pipe, that extends from a discharge port defined at a side of the circumferential surface of the washing water outflow pipe, and that is configured to supply steam in the outflow path to the steam nozzle; and a first protrusion that is disposed at an upper portion of the outflow path, that is disposed downstream of the discharge port with respect to a flow direction of washing water in the outflow path, and that is configured to guide steam toward the discharge port.

2. The dishwasher of claim 1, wherein the first protrusion has a semicircular shape that protrudes from the upper portion of the outflow path toward an inside of the outflow path.

3. The dishwasher of claim 1, wherein the outflow path includes an extension portion that extends vertically downward from the discharge port along the flow direction of washing water.

4. The dishwasher of claim 3, wherein the first protrusion is disposed vertically above an end of the extension portion of the outflow path.

5. The dishwasher of claim 3, wherein an inner diameter of the outflow path inside of the washing water outflow pipe is greater than or equal to a height of the first protrusion inward of the outflow path with respect to an inner surface of the washing water outflow pipe.

6. The dishwasher of claim 1, wherein a distance between the discharge port and the first protrusion is less than a half of an inner diameter of the outflow path inside of the washing water outflow pipe.

7. The dishwasher of claim 1, further comprising:

a switching valve disposed in an upper side of the washing water outflow pipe and configured to control supply of washing water discharged from the washing pump housing to at least one of the plurality of spray nozzles; and a washing water supply pipe that connects between the washing water outflow pipe and the switching valve and that has an inlet end connected to the washing water outflow pipe and an outlet end disposed vertically above the inlet end and connected to the switching valve, wherein the first protrusion is disposed at the inlet end of the washing water supply pipe.

8. The dishwasher of claim 1, wherein the steam discharge pipe extends in a direction inclined upward from the circumferential surface of the washing water outflow pipe and is disposed at an upper portion of the washing water outflow pipe.

9. The dishwasher of claim 1, wherein a height of the first protrusion inward of the outflow path with respect to an upper end of the outflow path is greater than a distance between a center of the discharge port and the upper end of the outflow path.

10. The dishwasher of claim 1, wherein the first protrusion includes:

a front surface that is inclined with respect to a reference horizontal line extending along an upper end of the washing water outflow pipe, the front surface facing upstream of washing water in the outflow path; and a rear surface that is inclined with respect to the reference horizontal line and to the front surface and that is disposed downstream of the front surface, and wherein a first inclination angle of the front surface defined in a first direction with respect to the reference horizontal line is less than a second inclination angle of the rear surface defined in a second direction opposite to the first direction with respect to the reference horizontal line.

11. The dishwasher of claim 7, wherein the outlet end of the washing water supply pipe defines a first opening opened in an upward direction, wherein the inlet end of the washing water supply pipe defines a second opening opened in a direction perpendicular to the upward direction, and wherein the first protrusion protrudes from a portion of the inlet end at which the flow direction of washing water in the washing water supply pipe changes toward the upward direction.

12. The dishwasher of claim 7, wherein the washing water supply pipe defines an insertion groove that is disposed between an outer circumferential surface of the washing water supply pipe and the first protrusion, the insertion groove being configured to receive the washing water outflow pipe.

13. The dishwasher of claim 1, further comprising:

a second protrusion that protrudes inward to the outflow path from an inside of the washing water outflow pipe and that is configured to block at least a portion of washing water discharged from the washing pump housing to thereby restrict flow of washing water into the discharge port.

14. The dishwasher of claim 13, wherein the second protrusion is disposed upstream of the discharge port in the outflow path.

15. The dishwasher of claim 13, wherein the discharge port is disposed between the first protrusion and the second protrusion.

16. The dishwasher of claim 7, wherein the washing water supply pipe comprises:

a horizontal pipe portion connected to the washing water outflow pipe;

a vertical pipe portion that is connected to the switching valve and that is perpendicular to the horizontal pipe portion; and a bending pipe portion that connects the horizontal pipe portion to the vertical pipe portion, and wherein the first protrusion is disposed in the horizontal pipe portion and the bending pipe portion.

17. A dishwasher comprising:

a tub that defines a washing chamber configured to accommodate one or more washing targets;

a sump configured to store washing water;

at least one spray nozzle configured to spray washing water stored in the sump to the washing chamber;

a washing pump configured to heat washing water in the sump to thereby generate steam and configured to supply washing water to the at least one spray nozzle;

a steam nozzle connected to the washing pump and configured to supply steam generated in the washing pump to the washing chamber; and a washing water supply pipe that defines a washing water supply flow path connected to the washing pump and that is configured to supply washing water from the washing pump to the at least one spray nozzle, wherein the washing pump comprises:

a washing pump housing that defines an outer shape of the washing pump and a pump space configured to receive washing water supplied from the sump, a heater configured to heat washing water in the washing pump housing, an impeller configured to cause at least one of flow of washing water or flow of steam in the washing pump housing, a washing motor configured to rotate the impeller, a washing water outflow pipe that defines an outflow path configured to discharge washing water based on rotation of the impeller and that protrudes outward from a side of a circumferential surface of the washing pump housing, and a steam discharge pipe that protrudes outward from a circumferential surface of the washing water outflow pipe, that extends from a discharge port defined at a side of the circumferential surface of the washing water outflow pipe, and that is configured to supply steam in the outflow path to the steam nozzle, and wherein the washing water supply pipe comprises a first protrusion that is disposed vertically above the outflow path and that is disposed at a coupling end of the washing water supply pipe coupled to the washing water outflow pipe.

18. The dishwasher of claim 17, wherein the outflow path includes an extension portion that extends vertically downward from the discharge port.

19. The dishwasher of claim 18, wherein the first protrusion is disposed vertically above an end of the extension portion of the outflow path.

20. The dishwasher of claim 18, wherein a height of the first protrusion inward of the outflow path with respect to an upper surface of the washing water outflow pipe is less than or equal to a vertical distance between a lower surface of the washing water outflow pipe and an upper surface of the extension portion.

* * * * *